US009303301B2

(12) United States Patent
Todoroki

(10) Patent No.: US 9,303,301 B2
(45) Date of Patent: Apr. 5, 2016

(54) BORON-CONTAINING STAINLESS STEEL HAVING EXCELLENT HOT WORKABILITY AND SURFACE PROPERTY

(75) Inventor: Hidekazu Todoroki, Kanagawa (JP)

(73) Assignee: NIPPON YAKIN KOGYO CO., LTD., Tokyo (JP)

( * ) Notice: Subject to any disclaimer, the term of this patent is extended or adjusted under 35 U.S.C. 154(b) by 82 days.

(21) Appl. No.: 14/238,312

(22) PCT Filed: Aug. 22, 2011

(86) PCT No.: PCT/JP2011/068823

§ 371 (c)(1), (2), (4) Date: Feb. 11, 2014

(87) PCT Pub. No.: WO2013/027253

PCT Pub. Date: Feb. 28, 2013

(65) Prior Publication Data

US 2014/0205486 A1 Jul. 24, 2014

(51) Int. Cl.
*C22C 38/54* (2006.01)
*C22C 38/58* (2006.01)
(Continued)

(52) U.S. Cl.
CPC ..... *C22C 38/58* (2013.01); *C22C 33/0285* (2013.01); *C22C 38/001* (2013.01); *C22C 38/002* (2013.01); *C22C 38/02* (2013.01); *C22C 38/04* (2013.01); *C22C 38/06* (2013.01);
(Continued)

(58) Field of Classification Search
CPC .... C22C 38/0002; C22C 38/04; C22C 38/06; C22C 38/12; C22C 38/14; C22C 38/20; C22C 38/22; C22C 38/26; C22C 38/28; C22C 38/32; C22C 38/38; C22C 38/42; C22C 38/44; C22C 38/46; C22C 38/48; C22C 38/50; C22C 38/54; C22C 38/58; C22C 38/60; C22C 38/001; C22C 38/002; C22C 38/034; C22C 38/005
See application file for complete search history.

(56) References Cited

U.S. PATENT DOCUMENTS

| | | | | |
|---|---|---|---|---|
| 2,967,770 | A * | 1/1961 | Hall et al. | 420/61 |
| 4,891,080 | A | 1/1990 | Del Corso et al. | |
| 2008/0240970 | A1 | 10/2008 | Eto et al. | |

FOREIGN PATENT DOCUMENTS

| | | |
|---|---|---|
| CN | 101275208 | 10/2008 |
| EP | 0 844 312 | 5/1998 |

(Continued)

OTHER PUBLICATIONS

NPL'1—Buschow et al. (2001), Encyclopedia of Materials—Science and Technology, vols. 1-11—Nonmetallic Inclusions and Their Effects on the Properties of Ferrous Alloys, pp. 6278-6283.*

(Continued)

*Primary Examiner* — Roy King
*Assistant Examiner* — Jophy S Koshy
(74) *Attorney, Agent, or Firm* — Greenblum & Bernstein, P.L.C.

(57) ABSTRACT

A boron-containing stainless steel having excellent hot workability and weldability and a good surface quality is proposed and is a boron-containing stainless steel comprising C: 0.001-0.15 mass %, Si: 0.1-2 mass %, Mn: 0.1-2 mass %, Ni: 5-25 mass %, Cr: 11-27 mass %, B: 0.05-2.5 mass %, Al: 0.005-0.2 mass %, O: 0.0001-0.01 mass %, N: 0.001-0.1 mass %, S: not more than 0.005 mass %, one or both of Mg: 0.0001-0.005 mass % and Ca: 0.0001-0.005 mass % and the remainder being Fe and inevitable impurities provided that a part of Si, Al, Mg, Ca and S is included as a non-metallic inclusion made of sulfide and/or oxysulfide.

2 Claims, 1 Drawing Sheet

(51) Int. Cl.

| | |
|---|---|
| ***C22C 33/02*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/44*** | (2006.01) |
| ***C22C 38/34*** | (2006.01) |
| *C21C 7/00* | (2006.01) |

(52) U.S. Cl.

CPC ..... *C22C38/34* (2013.01); *C22C 38/44* (2013.01); *C22C 38/54* (2013.01); *C21C 2007/0018* (2013.01)

(56) References Cited

FOREIGN PATENT DOCUMENTS

| | | | | |
|---|---|---|---|---|
| EP | 2 302 721 | | 3/2011 | |
| JP | 55-34636 | | 3/1980 | |
| JP | 1-92342 | | 4/1989 | |
| JP | 04-272131 | | 9/1992 | |
| JP | 05-320750 | | 12/1993 | |
| JP | 06-192792 | | 7/1994 | |
| JP | 06-207207 | | 7/1994 | |
| JP | 06-328196 | | 11/1994 | |
| JP | 08-225893 | | 9/1996 | |
| JP | 10-219399 | | 8/1998 | |
| JP | 11-158583 | | 6/1999 | |
| JP | 2002-38218 | | 2/2002 | |
| JP | 2002038218 | A * | 2/2002 | |
| JP | 2007277727 | A * | 10/2007 | ..... C22C 38/00 |

OTHER PUBLICATIONS

USPTO STIC Human Partial translation of JP 2007-277727 A of Todoroki.*

English Translation of the Written Opinion of the International Searching Authority for International Application No. PCT/JP2011/068823, which was issued on Feb. 25, 2014.

English Translation of the International Search Report for PCT/JP2011/068823, which was mailed on Nov. 22, 2011.

Chinese Office Action for CN 201180072982.X, mailed Apr. 1, 2015.

Extended European Search Report of EP Patent Application No. 11871326.2 mailed Oct. 7, 2014.

* cited by examiner

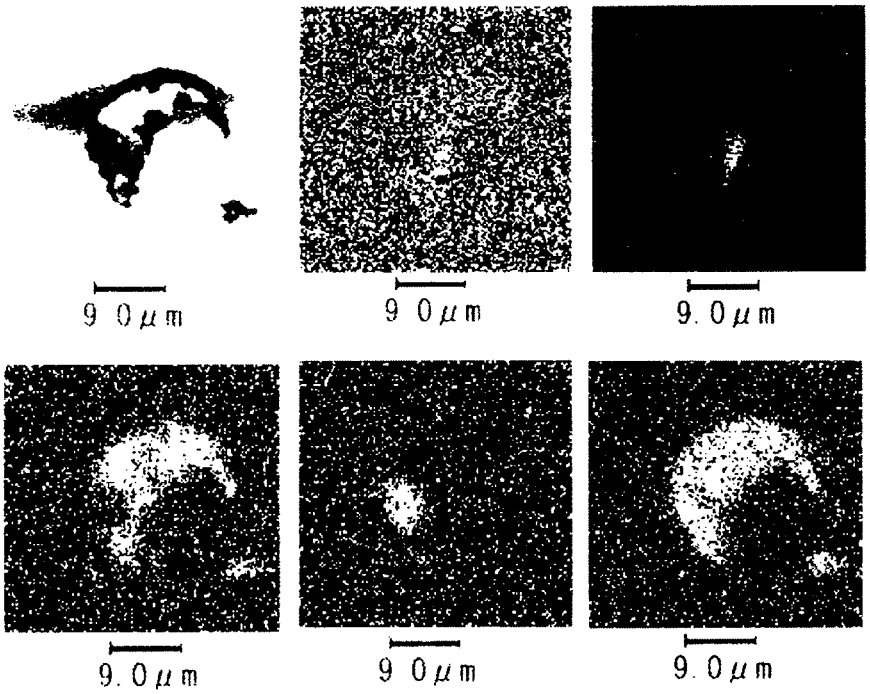
9.0μm
9.0μm
9.0μm
9.0μm
9.0μm
9.0μm

BORON-CONTAINING STAINLESS STEEL HAVING EXCELLENT HOT WORKABILITY AND SURFACE PROPERTY

TECHNICAL FIELD

This invention relates to a boron-containing stainless steel suitable as a material for spent nuclear fuel storage vessel in a nuclear power plant, and more particularly to a boron-containing stainless steel being excellent in the hot workability and weldability and less in the surface defect.

RELATED ART

Since boron-containing stainless steels are high in the neutron-absorbing capability and excellent in the corrosion resistance, they are used as a material for spent nuclear fuel storage vessel in a nuclear power plant or a shielding material therefor. The boron-containing stainless steel is metallographically an eutectic alloy of austenite and boride [$(Cr, Fe)_2B$] and has a problem that the hot workability is poor because the boride itself is brittle and the difference of strength at an interface between boride and austenite phases is large and hence cracking is easily propagated.

As a technique for improving such a problem are proposed (1) a method of subjecting a hot rolled steel strip to a heat treatment in Patent Document 1, (2) a method of cooling a hot melt of boron-containing austenitic stainless steel with stirring and casting at a semi-solidified slurry state with an overheat of not higher than 5° C. and a solidus rate of not more than 0.5 in Patent Document 2, and (3) a method wherein a nitrogen gas atomized powder of not more than 500 μm containing B, C, Si, Cr, Ni, Mo, N and O is filled in a soft steel can under vacuum and thereafter subjected to HIP treatment at specified temperature and pressure to attain micronization of boride and improve ductility, toughness and corrosion resistance of steel sheet to thereby eliminate ear cracking during hot rolling in Patent Document 3.

PRIOR ART DOCUMENTS

Patent Documents

Patent Document 1: JP-A-H05-320750
Patent Document 2: JP-A-H06-328196
Patent Document 3: JP-A-H06-207207

SUMMARY OF THE INVENTION

Task to be Solved by the Invention

As mentioned above, there have hitherto been proposed some techniques for improving the hot workability of the boron-containing stainless steel. However, the conventional techniques as disclosed in Patent Documents 1-3 have problems that the step number increases and general-purpose equipment is not utilized and hence the cost is increased and the reality is lacking. On the other hand, defects resulted from inclusions come into problem, and the improvement becomes imperative. Namely, these conventional techniques do not improve the properties of the alloy itself such as hot workability, weldability and surface quality, so that it is actual to produce these stainless steels by grooming after rolling.

It is, therefore, an object of the invention to propose a boron-containing stainless steel being excellent in the hot workability and weldability and good in the surface quality.

Solution for Task

In order to attain the above object in consideration of the aforementioned problems of the conventional techniques, the inventors have first done experiments for examining an influence of various factors on the hot workability of the boron-containing stainless steel. In these experiments, a steel ingot is prepared by melting an alloy comprising 19.5 mass % of Cr, 10.3 mass % of Ni, 1 mass % of B in addition to various trace ingredients and the remainder mainly being Fe in a high-frequency induction melting furnace. In this case, the capacity of the melting furnace used is 20 kg, and a crucible made of magnesia or alumina is used. As the trace ingredients are particularly selected elements of Al, Mg and Ca.

As seen from the results of this experiment, S is largely affected in addition to an essential problem that the boride is brittle. That is, when S concentration in steel is high, the hot workability is deteriorated to easily cause ear cracking in the hot rolling step. However, the bad influence of S can be mitigated only by adding a slight amount of Ca or Mg strongly bonding to S in the steel. Because, these elements directly form CaS or MgS and act to reduce solid-soluted S and can render S harmless by dissolving S into an oxide series inclusion of $CaO—Al_2O_3—MgO—SiO_2$. This is also considered due to the fact that such an action is developed by melting $CaO—Al_2O_3—MgO—SiO_2$ series oxide in molten steel to enhance the solubility of S.

Based on these experimental results is further conducted a production experiment in an actual equipment using an electric furnace, argon oxygen decarburization (AOD), vacuum oxygen decarburization (VOD) or the like. As a result, it has been confirmed that Ca or Mg is good to be added in the form of an alloying element and that the addition of Al to molten steel can reduce CaO or MgO in the $CaO—SiO_2—Al_2O_3—MgO—S$ series refining slag in AOD or VOD.

However, it has been also found that the addition of Al, Mg, Ca may have harmful effects and if the addition amount is too large, black points may be caused on weld beads and hence it is necessary to stop the addition in a proper amount.

Further, it has been found out that major part of the product defects results from scab-like defect generated in the hot rolling based on the deterioration of the hot workability or large inclusions. As the large inclusions have been again investigated, it has been found that the above defects easily appear when the inclusion contains not less than 20 mass % of $B_2O_3$. This is considered due to the fact that B is oxidized in molten steel to form a non-metallic inclusion. Moreover, this phenomenon appears when deoxidation is insufficient. Especially, it is considered that when Al amount is small, oxygen concentration in steel is increased to produce a large amount of B oxide as a large inclusion and such an inclusion retains in the interior of the steel without floating for separation and generates defects.

The invention is developed based on the above knowledge obtained by the experiments or through test ingot making, and particularly proposes a boron-containing stainless steel having excellent mechanical properties such as neutron-absorbing capability, strength and the like.

The invention is developed under the above knowledge and is a boron-containing stainless steel having excellent hot workability and surface quality, which comprises C: 0.001-0.15 mass %, Si: 0.1-2 mass %, Mn: 0.1-2 mass %, Ni: 5-25 mass %, Cr: 11-27 mass %, B: 0.05-2.5 mass %, Al: 0.005-0.2 mass %, O: 0.0001-0.01 mass %, N: 0.001-0.1 mass %, S: not more than 0.005 mass %, one or both of Mg: 0.0001-0.005 mass % and Ca: 0.0001-0.005 mass % and the remainder being Fe and inevitable impurities provided that a part of Si, Al, Mg, Ca and S is included as a non-metallic inclusion made of sulfide and/or oxysulfide.

Moreover, the boron-containing stainless steel of the invention has preferable solutions that (1) Mo is further contained in an amount of 0.1-3 mass % in addition to the above ingredients, and (2) the non-metallic inclusion is either one or more of sulfide such as MgS or CaS and CaO—$Al_2O_3$—MgO—$SiO_2$—S series oxysulfide, and (3) the CaO—$Al_2O_3$—MgO—$SiO_2$—S series oxysulfide has a composition of CaO: 20-70 mass %, $Al_2O_3$: 5-60 mass %, $SiO_2$: not more than 15 mass %, MgO: 0.5-30 mass % and S: not more than 15 mass %.

Effect of the Invention

According to the boron-containing stainless steel of the invention having the aforementioned construction, the hot workability and weldability are excellent and also the surface quality is good, and such a stainless steel can be produced in a low coat, so that the invention is very advantageous in industry.

BRIEF DESCRIPTION OF THE DRAWING

FIG. 1 is SEM photographs showing non-metallic inclusions and elementary distribution thereof.

EMBODIMENTS FOR CARRYING OUT THE INVENTION

The reason why each ingredient in the boron-containing stainless steel according to the invention is limited to the above range will be described below.

C: 0.001-0.15 mass %

C is an element useful for ensuring the strength of steel and is necessary to be at least 0.001 mass %. However, if C content is too large, Cr carbide is formed in the stainless steel to rather decrease an effective Cr content contributing to corrosion resistance. Therefore, C content is 0.001-0.15 mass %.

Si: 0.1-2 mass %

Si is required in an amount of at least 0.1 mass % for decreasing an oxygen concentration in molten steel in view of the refining. However, when Si content exceeds 2 mass %, the hot workability is deteriorated. Therefore, Si content is 0.1-2 mass %.

Mn: 0.1-2 mass %

Mn is a deoxidizing element likewise Si and is an ingredient required for refining. However, when Mn content exceeds 2 mass %, retaining of induced radioactivity becomes large. Therefore, Mn content is 0.1-2 mass %.

Ni: 5-25 mass %

Ni is a basic ingredient of stainless steel together with Cr and is an ingredient required for stabilizing austenite phase. Especially, Ni in the boron-containing stainless steel is hardly incorporated into the boride and is not consumed in boride phase, so that the effect is sufficiently obtained in an amount of not less than 5 mass %. While, when Ni content exceeds 25 mass %, the effect is saturated and not only the cost is increased but also the liquidus-line temperature of steel is dropped to cause shrinkage cavity or the like in the casting. Therefore, Ni content is 5-25 mass %. Preferably, it is 7-13 mass %.

Cr: 11-27 mass %

Cr is a basic ingredient of stainless steel together with Ni, and is an element effective for the formation of a passive film required for ensuring corrosion resistance on the steel surface. However, when Cr content exceeds 27 mass %, the embrittlement of steel becomes remarkable and is practically undesirable. Therefore, Cr content is 11-27 mass %. Preferably, it is added in an amount of not less than 18 mass % capable of ensuring more excellent corrosion resistance. Also, it is not more than 25 mass % for suppressing the embrittlement. More preferably, it is 19-24 mass %.

B: 0.05-2.5 mass %

B is an element required for neutron-absorbing capability and is mainly existent in the form of boride [$(Cr, Fe)_2B$] in steel. In order to develop the neutron-absorbing capability, B is necessary to be added in an amount of at least 0.05 mass %. On the other hand, when B content is not more than 2.5-mass %, a primary crystal is austenite and sufficient strength and ductility are developed in the casting without causing the cracking. However, when B content exceeds 2.5 mass %, a primary crystal is [$(Cr, Fe)_2B$] and the cracking is caused in the casting and the strength, wear resistance and workability of the material are deteriorated. Therefore, B content is a range of 0.05-2.5 mass %. Moreover, it is preferably a range of 0.2-2 mass % from the viewpoint of sufficiently ensuring the neutron-absorbing capability, and is more preferably a range of 0.5-1.8 mass % in case of considering both the neutron-absorbing capability and the workability.

Al: 0.005-0.2 mass %

Al is an ingredient acting as a deoxidizing ingredient in the invention. When Al content is less than 0.005 mass %, deoxidation of molten steel is insufficient and oxygen concentration exceeds 0.01 mass %. As a result, large-size non-metallic inclusions including $B_2O_3$ are formed to cause surface defects in the product. While, when Al content exceeds 0.2 mass %, CaO or MgO in the slag is excessively reduced to render the Ca or Mg amount in steel into more than 0.005 mass %, and hence black points may be caused on weld beads. Therefore, Al content is 0.005-0.2 mass %. Considering the above action and effects by the addition of Al, the content is preferably a range of 0.01-0.2 mass %, and more preferably a range of 0.015-0.15 mass %.

O: 0.0001-0.01 mass %

O leads to defects through the formation of inclusions and is desirable to be made lower. When O content exceeds 0.01 mass %, not only $B_2O_3$ is apt to be easily generated, but also large-size non-metallic inclusions are formed to easily cause defects on the surface of the product. While, when it is less than 0.0001 mass %, CaO or MgO in the slag is reduced to increase Ca or Mg content, which is incorporated in an amount of more than 0.005 mass %. As a result, black points are caused on the weld beads. Moreover, O content can be made to the above range by adjusting Al content to 0.005-0.2 mass %. Therefore, O content is 0.0001-0.01 mass %. It is preferably 0.0003-0.005 mass %, and more preferably 0.0005-0.004 mass %.

N: 0.001-0.1 mass %

N is an element improving the strength and corrosion resistance of the stainless steel. When N content exceeds 0.1 mass %, the strength is too high and the workability is deteriorated. Also, N forms BN and obstructs the formation of the boride. Therefore, N content is defined to 0.001-0.1 mass %. Preferably, it is 0.003-0.03 mass %.

S: not more than 0.005 mass %

Since S is an ingredient deteriorating the hot workability, it is desirable to make the content as few as possible. Therefore, S content is not more than 0.005 mass %.

Mg: 0.0001-0.005 mass %

In the invention, Mg is an ingredient playing an important role for sufficiently ensuring the hot workability. When Mg content is less than 0.0001 mass %, solid-soluted S formed by fixing S as MgS cannot be reduced sufficiently. While, when it exceeds 0.005 mass %, there is a problem that black points are caused on the weld beads. Mg may be added by reducing MgO in the slag with Al or may be added in the form of an alloy such as NiMg or the like. Therefore, Mg content is 0.0001-0.005 mass %. Preferably, Mg content is 0.0001-0.002 mass %.

Ca: 0.0001-0.005 mass %

In the invention, Ca is an ingredient playing an important role for sufficiently ensuring the hot workability. When Ca content is not less than 0.0001 mass %, S can be fixed as CaS to sufficiently reduce solid-soluted S. While, when it exceeds 0.005 mass %, there is a problem that black points are caused on the weld beads. Ca may be added by reducing CaO in the slag with Al, or may be added in the form of an alloy such as NiCa or the like or as an auxiliary material such as CaAl wire, CaSi wire or the like. Therefore, Ca content is 0.0001-0.005 mass %. Preferably, it is 0.0001-0.002 mass %.

Mo: 0.1-3 mass %

Mo is added, if necessary because it has an action of applying the corrosion resistance by about 3 times higher than that of Cr and is an ingredient very effective for the improvement of the corrosion resistance. In order to effectively improve the corrosion resistance, it is necessary to be added in an amount of not less than 0.1 mass %. While, when it exceeds 3 mass %, the embrittlement is caused or the cost is increased undesirably. Therefore, Mo content is 0.1-3 mass %.

Moreover, the ingredient other than the above ingredients is a reminder ingredient constituted with Fe and inevitable impurities.

In the invention, a part of Si, Al, Mg, Ca and S among the above ingredients is particularly existent in steel as a non-metallic inclusion made of sulfide and/or oxysulfide as shown in FIG. 1. That is, the boron-containing stainless steel according to the invention contains a non-metallic inclusion as mentioned below.

Either one or more of sulfides such as MgS and CaS and CaO—$Al_2O_3$—MgO—$SiO_2$—S series oxysulfide:

Since all of these non-metallic inclusions have an action of absorbing S detrimental to the hot workability to decrease S solid soluted in steel, it is effective to have such an inclusion composition. Moreover, it is possible to provide either one or more of sulfides such as MgS and CaS and CaO—$Al_2O_3$—MgO—$SiO_2$ series oxysulfide by adjusting concentrations of Si, Al, Mg, Ca and O to the aforementioned ranges.

Among these non-metallic inclusions, the CaO—$Al_2O_3$—MgO—$SiO_2$—S series oxysulfide is preferable to have a composition comprising CaO: 20-70 mass %, $Al_2O_3$: 5-60 mass %, $SiO_2$: not more than 15 mass %, MgO: 0.5-30 mass % and S: not more than 15 mass %. Because, the CaO—$Al_2O_3$—MgO—$SiO_2$—S series oxysulfide cannot keep a molten state in molten steel when the concentration of each of CaO, $Al_2O_3$, $SiO_2$ and MgO does not satisfy the above range. In this case, S cannot be dissolved into these oxides effectively. When $SiO_2$ exceeds 15 mass %, the dissolution of S into the inclusion is not obstructed. In case of the CaO—$Al_2O_3$—MgO—$SiO_2$—S series oxysulfide, therefore, CaO is 20-70 mass %, $Al_2O_3$ is 5-60 mass %, $SiO_2$ is not more than 15 mass %, and MgO is 0.5-30 mass %. As a result, it is possible to dissolve S into the inclusion within a range of not more than 15 mass % (within given limit).

When not less than 20 mass % of $B_2O_3$ is incorporated into the CaO—$Al_2O_3$—MgO—$SiO_2$—S series oxysulfide, if oxygen concentration exceeds over 0.01 mass %, the inclusion is made larger. Therefore, $B_2O_3$ in the CaO—$Al_2O_3$—MgO—$SiO_2$—S series oxysulfide should be less than 20 mass %. To this end, Al is enough to be controlled to the range defined in the invention.

As a composition of the non-metallic inclusion, MgO and MgO.$Al_2O_3$ do not obstruct the effect of the invention even if they are included in the non-metallic inclusion at an amount of not more than 50 mass %. However, $Al_2O_3$ forms a cluster and brings about the occurrence of surface defects. This can be prevented by controlling the Ca and Mg contents to the ranges defined in the invention.

The method of producing the boron-containing stainless steel will be described below.

A compounded material is first melted in an electric furnace, and then decarburized in AOD and/or VOD by blowing Ar or nitrogen and oxygen, and thereafter lime stone or fluorite is charged and further ferrosilicon or aluminum and ferrosilicon is charged to conduct reduction treatment of chromium oxide migrated into a slag phase. After deoxidation and desulfurization are conducted by adding aluminum, a given amount of a boron source such as FeB or the like is added. Then, the ingredient-formulated molten steel is cast by a continuous casting method or a normal ingot-making method. In case of the normal ingot-making method, a slab is formed by hot forging and subjected to hot rolling and cold rolling to obtain a boron-containing stainless steel sheet.

In this production is used a melting material properly selected from ferronickel, pure nickel, ferrochromium, chromium, iron scraps, stainless scraps, Fe—Ni alloy scraps and the like.

In this production method, a refractory of AOD furnace, VOD furnace or ladle is not particularly limited, and is properly selected from MgO—C, $Al_2O_3$—MgO—C, dolomite and magnesia-chrome. In this case, the charging amounts of aluminum and ferrosilicon after the charging of lime stone and fluorite are adjusted so as to render Al content and Si content into 0.005 mass %≤Al≤0.2 mass % and 0.1 mass %≤Si≤2 mass %, respectively. By this operation is made O content to a range of 0.0001-0.01 mass %, and $B_2O_3$ is not produced in the non-metallic inclusion by the subsequent B addition, so that it is effective to prevent the formation of large-size inclusion.

As seen from the above explanation, Al reduces CaO or MgO existing in the slag and supplies Ca or Mg to molten steel. However, when Ca or Mg content is not within the aforementioned acceptable range defined in the invention, an auxiliary material such as NiMg, NiCa, CaAl wire, CaSi wire or the like may be added properly. In this case, Ca and Mg are reacted with S to reduce solid-soluted S.

In the invention, a preferable slag is CaO—$Al_2O_3$—MgO—$SiO_2$—S system and may contain no more than 5 mass % in total of FeO, Cr oxide, S, P, $TiO_2$. Since magnesia system is used as a refractory in the invention, magnesia brick scraps may be properly added into the slag for protecting the refractory. Thereafter, stirring is conducted by blowing Ar or nitrogen to promote deoxidation and desulfurization, whereby oxygen concentration and S concentration are controlled to 0.0001 mass %≤O≤0.01 mass % and S≤0.005 mass %, respectively. The S concentration is fundamentally decreased to not more than 0.005 mass % by desulfurization with the slag.

After the chemical composition of steel and the composition of the non-metallic inclusion are controlled to constant levels as mentioned above, molten steel is cast by a continuous casting method or a normal ingot-making method. In this case, superheat degree of molten steel is preferable to be 10-60° C. in case of the continuous casting method and 30-150° C. in case of the normal ingot-making method in view of the productivity. Also, an interior of a tundish in case of the continuous casting method and an interior of an ingot in case of the normal ingot-making method are preferable to be sealed with Ar or nitrogen in order to prevent oxidation of an active ingredient in molten steel such as Al, Mg or Ca.

EXAMPLE

In this example, a starting material selected from ferronickel, pure nickel, ferrochromium, iron scraps, stainless scraps, Fe—Ni alloy scraps and the like is melted in an electric furnace of 60 tons in capacity and then subjected to oxidation refining in AOD. Moreover, a part of the charge is refined only in VOD without using AOD. Thereafter, lime stone and fluorite are charged to form $CaO—Al_2O_3—MgO—SiO_2—S$ series slag. Then, aluminum and/or ferrosilicon are charged to conduct chromium reduction. Thereafter, Al is charged to conduct deoxidation and desulfurization, and finally FeB is charged to adjust B concentration to a given level. The thus melted steel is cast in a continuous casting machine to obtain a slab, which is subjected to hot rolling and cold rolling to obtain a B-containing stainless steel sheet having a thickness of 5 mm. The thus obtained cold rolled steel sheet is subjected to the following evaluation tests.

a. Chemical composition: As regards a sample cut out from the B-containing stainless steel sheet having a chemical composition shown in Table 1, oxygen and nitrogen are analyzed by an oxygen-nitrogen simultaneous analyzing apparatus, and carbon and sulfur are analyzed by a carbon-sulfur simultaneous analyzing apparatus. The other elements are analyzed by a fluorescent X-ray analyzing apparatus.

b. Composition of non-metallic inclusion: A test piece of 15 mm square is cut out from a sample taken from a tundish and mirror-polished to randomly quantify 30 inclusions with EDS.

c. Ear cracking: It is evaluated by cracking after hot rolling. A case that the yield falls below 90% due to the cracking is expressed by X.

d. Surface quality: A full length of a typical one coil is visually observed to evaluate degree of surface defects. A case that polishing for repair is required due to the presence of the defects is expressed by X.

e. Weldability: The presence or absence of black points on a bead is visually evaluated after TIG welding is conducted under conditions that a current is 120 A and a welding rate is 200 mm/min. The generation of black points is expressed by X.

The results of this example are shown in Table 2. As shown in Table 2, all of Invention Examples (No. 1-15) satisfy the chemical composition range defined in the invention and have no problem in the ear cracking, surface quality and weldability. FIG. 1 is an example of $CaO—Al_2O_3—MgO—SiO_2—S$ series oxysulfide contained in No. 6 alloy.

In Comparative Examples (No. 16-21), since any one or more of the ingredients is outside of the range defined in the invention, there is a problem that the ear cracking is generated, or the surface defects are generated, or the black points are generated in the welding.

TABLE 1

| | | Chemical composition (mass %) | | | | | | | | | | | | |
|---|---|---|---|---|---|---|---|---|---|---|---|---|---|---|
| | No. | C | Si | Mn | Ni | Cr | B | Al | Mg | Ca | Mo | O | N | S |
| Invention Example | 1 | 0.016 | 0.76 | 0.94 | 10.33 | 19.55 | 1.16 | 0.069 | 0.0003 | 0.0005 | — | 0.0007 | 0.009 | 0.0002 |
| | 2 | 0.021 | 0.75 | 0.95 | 10.29 | 19.67 | 1.13 | 0.045 | 0.0002 | 0.0014 | — | 0.0017 | 0.012 | 0.0005 |
| | 3 | 0.015 | 0.75 | 0.94 | 12.51 | 19.74 | 1.18 | 0.056 | 0.0003 | 0.0005 | — | 0.0008 | 0.015 | 0.0008 |
| | 4 | 0.035 | 1.23 | 1.56 | 10.56 | 19.87 | 1.09 | 0.007 | 0.0025 | 0.0002 | 0.15 | 0.0086 | 0.025 | 0.0024 |
| | 5 | 0.025 | 0.76 | 0.94 | 10.36 | 19.55 | 1.16 | 0.135 | 0.0003 | 0.0043 | — | 0.0007 | 0.009 | 0.0012 |
| | 6 | 0.021 | 0.75 | 0.95 | 10.29 | 19.67 | 1.13 | 0.089 | 0.0005 | 0.0018 | — | 0.0002 | 0.012 | 0.0005 |
| | 7 | 0.015 | 0.52 | 0.94 | 12.51 | 19.21 | 1.18 | 0.006 | 0.0003 | 0.0005 | — | 0.0068 | 0.015 | 0.0001 |
| | 8 | 0.013 | 0.76 | 0.95 | 10.18 | 19.55 | 1.16 | 0.069 | 0.0003 | 0.0005 | 0.58 | 0.0007 | 0.009 | 0.0005 |
| | 9 | 0.013 | 0.76 | 0.95 | 10.18 | 19.57 | 1.25 | 0.036 | 0.0011 | 0.0005 | 1.21 | 0.0012 | 0.009 | 0.0008 |
| | 10 | 0.035 | 1.85 | 1.56 | 10.56 | 19.87 | 1.09 | 0.022 | 0.0032 | 0.0002 | — | 0.0035 | 0.025 | 0.0024 |
| | 11 | 0.005 | 0.75 | 1.36 | 7.85 | 23.56 | 0.59 | 0.175 | 0.0008 | 0.0035 | — | 0.0005 | 0.052 | 0.0007 |
| | 12 | 0.087 | 0.35 | 0.32 | 22.32 | 12.35 | 0.86 | 0.053 | 0.0042 | 0.0002 | — | 0.0015 | 0.003 | 0.0015 |
| | 13 | 0.015 | 0.75 | 0.94 | 10.26 | 19.74 | 1.35 | 0.016 | 0.0002 | 0.0015 | 2.14 | 0.0022 | 0.015 | 0.0045 |
| | 14 | 0.016 | 0.76 | 1.02 | 10.35 | 19.55 | 1.75 | 0.012 | 0.0003 | 0.0003 | 0.25 | 0.0007 | 0.009 | 0.0008 |
| | 15 | 0.025 | 0.76 | 0.94 | 10.14 | 19.55 | 1.16 | 0.089 | 0.0032 | 0.0035 | — | 0.0001 | 0.009 | 0.0006 |
| Comparative Example | 16 | 0.018 | 0.75 | 0.98 | 10.29 | 19.67 | 1.13 | 0.003 | 0.00002 | 0.00001 | — | 0.0017 | 0.012 | 0.0012 |
| | 17 | 0.023 | 0.05 | 0.88 | 10.15 | 19.63 | 0.52 | 0.002 | 0 | 0 | — | 0.0178 | 0.028 | 0.0097 |
| | 18 | 0.025 | 0.76 | 0.94 | 10.36 | 19.55 | 1.16 | 0.004 | 0.0003 | 0.00005 | — | 0.0112 | 0.009 | 0.0058 |
| | 19 | 0.017 | 0.75 | 0.95 | 10.56 | 19.47 | 1.09 | 0.359 | 0.0062 | 0.0073 | — | 0.00005 | 0.008 | 0.0001 |
| | 20 | 0.015 | 0.78 | 0.95 | 10.58 | 19.38 | 1.32 | 0.008 | 0.00001 | 0.00001 | — | 0.0025 | 0.013 | 0.0001 |
| | 21 | 0.015 | 2.58 | 0.95 | 10.23 | 19.38 | 0.71 | 0.015 | 0.00001 | 0.00001 | — | 0.0011 | 0.013 | 0.0001 |

* The remainder is Fe and inevitable impurities.

TABLE 2

| | | Composition of inclusion (mass %) | | | | | | | | | | | | Evaluation | | |
|---|---|---|---|---|---|---|---|---|---|---|---|---|---|---|---|---|
| | | $CaO—Al_2O_3—MgO—SiO_2$ system (mass %) | | | | | | | MgO | $Al_2O_3$ | $MgO \cdot Al_2O_3$ | CaS | MgS | Ear | Surface | |
| No. | | CaO | $Al_2O_3$ | MgO | $SiO_2$ | $B_2O_3$ | S | n | n | n | n | n | n | cracking | defects | Weldability |
| Invention Example | 1 | 54.2 | 28.6 | 10.5 | 5.2 | 0 | 1.5 | 20 | 3 | 0 | 2 | 4 | 1 | ○ | ○ | ○ |
| | 2 | 45.3 | 38.3 | 10.6 | 3.5 | 0 | 2.3 | 24 | 1 | 0 | 1 | 4 | 0 | ○ | ○ | ○ |
| | 3 | 38.6 | 45.3 | 10.7 | 1.8 | 0 | 3.6 | 10 | 6 | 0 | 2 | 9 | 3 | ○ | ○ | ○ |
| | 4 | 25.3 | 48.6 | 11.7 | 13.5 | 0 | 0.9 | 8 | 10 | 0 | 5 | 1 | 6 | ○ | ○ | ○ |
| | 5 | 66.8 | 23.5 | 7.9 | 0.5 | 0 | 1.3 | 11 | 2 | 0 | 1 | 15 | 1 | ○ | ○ | ○ |
| | 6 | 58.6 | 36.8 | 1.2 | 1.1 | 0 | 2.3 | 5 | 5 | 0 | 1 | 12 | 7 | ○ | ○ | ○ |

TABLE 2-continued

| | | Composition of inclusion (mass %) | | | | | | | | | | | | Evaluation | | |
|---|---|---|---|---|---|---|---|---|---|---|---|---|---|---|---|---|
| | | $CaO—Al_2O_3—MgO—SiO_2$ system (mass %) | | | | | | | MgO | $Al_2O_3$ | $MgO \cdot Al_2O_3$ | CaS | MgS | Ear | Surface | |
| No. | | CaO | $Al_2O_3$ | MgO | $SiO_2$ | $B_2O_3$ | S | n | n | n | n | n | n | cracking | defects | Weldability |
| | 7 | 45.1 | 15.2 | 28.1 | 10.5 | 0 | 1.1 | 30 | 0 | 0 | 0 | 0 | 0 | ○ | ○ | ○ |
| | 8 | 52.3 | 36.9 | 3.8 | 5.2 | 0 | 1.8 | 30 | 0 | 0 | 0 | 0 | 0 | ○ | ○ | ○ |
| | 9 | 23.1 | 49.5 | 17.3 | 7.6 | 0 | 2.5 | 8 | 1 | 0 | 1 | 0 | 0 | ○ | ○ | ○ |
| | 10 | 25.3 | 48.6 | 11.5 | 14.3 | 0 | 0.3 | 20 | 3 | 0 | 0 | 0 | 7 | ○ | ○ | ○ |
| | 11 | 63.5 | 8.5 | 3.1 | 13.6 | 0 | 11.3 | 30 | 0 | 0 | 0 | 0 | 0 | ○ | ○ | ○ |
| | 12 | 21.2 | 45.3 | 32.3 | 0.1 | 0 | 1.1 | 7 | 10 | 0 | 0 | 0 | 13 | ○ | ○ | ○ |
| | 13 | 56.3 | 20.3 | 5.5 | 12.3 | 0 | 5.6 | 22 | 0 | 0 | 0 | 8 | 0 | ○ | ○ | ○ |
| | 14 | 35.6 | 54.3 | 4.7 | 3.6 | 0 | 1.8 | 23 | 0 | 0 | 0 | 3 | 4 | ○ | ○ | ○ |
| | 15 | — | — | — | — | — | — | 0 | 1 | 0 | 0 | 14 | 15 | ○ | ○ | ○ |
| Comparative | 16 | 1.1 | 65.3 | 0.1 | 33.5 | 0 | 0 | 28 | 0 | 0 | 2 | 0 | 0 | X | ○ | ○ |
| Example | 17 | 0 | 2.3 | 1.9 | 57.2 | 38.6 | 0 | 30 | 0 | 0 | 0 | 0 | 0 | X | X | ○ |
| | 18 | 1.2 | 35.8 | 0.4 | 37.3 | 25.3 | 0 | 30 | 0 | 0 | 0 | 0 | 0 | X | X | ○ |
| | 19 | 71.2 | 16.3 | 12 | 0 | 0 | 0.5 | 30 | 0 | 0 | 0 | 0 | 0 | ○ | ○ | X |
| | 20 | — | — | — | — | — | — | 0 | 0 | 29 | 1 | 0 | 0 | ○ | X | ○ |
| | 21 | — | — | — | — | — | — | 0 | 0 | 30 | 0 | 0 | 0 | ○ | X | ○ |

n: Number (30 in total)

INDUSTRIAL APPLICABILITY

The B-containing stainless steel adapted in the invention is mainly used as a material for spent nuclear fuel storage vessel in a nuclear power plant or a shielding material therefor, and is also effective as a material in the field of double-phase stainless steel, Ni-based alloy and the like requiring the hot workability.

The invention claimed is:

1. A boron-containing stainless steel, which comprises

C: 0.001-0.15 mass %,

Si: 0.1-2 mass %,

Mn: 0.1-2 mass %,

Ni: 5-25 mass %,

Cr: 11-27 mass %,

B: 0.5-2.5 mass %,

Al: 0.005-0.2 mass %,

O: 0.0001-0.01 mass %,

N: 0.001-0.1 mass %,

S: not more than 0.005 mass %, one or both of Mg: 0.0001-0.005 mass % and Ca: 0.0001-0.005 mass % and the remainder being Fe and inevitable impurities, wherein a contained nonmetallic inclusion of $CaO—Al_2O_3—MgO—SiO_2—S$ series oxysulfide has a composition of CaO: 20-70 mass %, $Al_2O_3$: 5-60 mass %, $SiO_2$: not more than 15 mass %, MgO: 0.5-30 mass % and S: not more than 15 mass %.

2. A boron-containing stainless steel according to claim 1, wherein Mo is further contained in an amount of 0.1-3 mass % in addition to the above ingredients.

* * * * *